US006546662B1

(12) United States Patent
Chong

(10) Patent No.: US 6,546,662 B1
(45) Date of Patent: Apr. 15, 2003

(54) COLLAPSIBLE SHOOTER'S PLATFORM

(76) Inventor: Robert S. Y. Chong, 98-1137 Kaonohi St., Aiea, HI (US) 96701

( * ) Notice: Subject to any disclaimer, the term of this patent is extended or adjusted under 35 U.S.C. 154(b) by 0 days.

(21) Appl. No.: 09/999,145

(22) Filed: Oct. 30, 2001

(51) Int. Cl.[7] ..... F41A 27/00
(52) U.S. Cl. ..... 42/94
(58) Field of Search ..... 42/94; 43/21.2, 43/54.1

(56) References Cited

U.S. PATENT DOCUMENTS 3,282,164 A * 11/1966 Vickers ..... 89/40.06
3,667,773 A * 6/1972 Hess ..... 248/186.1
4,345,398 A 8/1982 Pickett
4,535,559 A 8/1985 Hall
4,645,167 A * 2/1987 Hardwick ..... 248/283.1
4,702,029 A 10/1987 DeVaul et al.
5,060,410 A 10/1991 Mueller
5,149,900 A 9/1992 Buck
5,173,563 A 12/1992 Gray
5,271,175 A 12/1993 West, III
5,287,643 A 2/1994 Arizpe-Gilmore
5,414,949 A 5/1995 Peebles
D377,823 S * 2/1997 Rainwater ..... D22/108
5,685,104 A 11/1997 Breazeale, Jr.
5,688,024 A * 11/1997 Arizpe-Gilmore ..... 297/217.1
5,715,625 A * 2/1998 West, III ..... 42/94

* cited by examiner

*Primary Examiner*—Michael J. Carone
*Assistant Examiner*—Denise J Buckley
(74) *Attorney, Agent, or Firm*—Carrie E. Peterman; Quirk & Tratos

(57) ABSTRACT

A portable support assembly includes a central generally elongated panel piece flanked at both sides by lateral panel pieces which extend adjacent a portion of the central piece. Both the central piece and the two flanking pieces include a transverse slot for receiving an insert extending across the panel assembly. The lower common surfaces of the panels are slotted with three recesses, the first extending longitudinally from the front into the central piece and the other two aligned diagonally towards each other from the rear corners of the lateral pieces and into the central piece. Legs are then inserted into each recess to provide the support for the assembly and also to interlock the flanking pieces together to the center piece. One leg includes a mount for an adjustable front firearm support while a shaped transverse recess in the center piece receives a slide deploying an adjustable rear firearm support.

13 Claims, 4 Drawing Sheets

24
24-1
14-2
14r
14
11-3
11
16-2
16r
26
26-1
14-1
21
14f
11-2
11-1
13
16
16f
16-1
32
34
12-2
10
28
29
31-5
31-2
31-1
12f
24
25-1
26-1
27
26
25-5
25-6
25-2

COLLAPSIBLE SHOOTER'S PLATFORM

BACKGROUND OF THE INVENTION

1. Field of the Invention

The present invention relates to shooters' platforms, and more particularly to a portable, collapsible structure which in its erected form supports both the shooter and the firearm.

2. Description of the Prior Art

Devices for supporting a marksman and his firearm have been known in the past. In their typical exemplification these earlier devices comprise either a large complement of separate structures or only limited support. For example, U.S. Pat. No. 5,414,949 to Peebles describes an adjustable shooting stand characterized by a base of substantial dimensions onto which seat structures and the firearm supports are variably mounted. While suitable for the purposes intended, the geometric separation of the support and the seat mounting both demand substantial dimensions in the base. Similarly large platform structures are taught in U.S. Pat. No. 5,173,563 to Gray and U.S. Pat. No. 5,271,175 to West III.

At the other extreme are those structures that focus on their transport convenience. Examples of such lightweight structures can be found in the teachings of U.S. Pat. No. 4,345,398 to Pickett, U.S. Pat. No. 5,149,900 to Buck, U.S. Pat. No. 5,287,643 to Arizpe-Gilmore, and others. While once again suitable for the purposes intended, these earlier examples exchange structural efficacy light weight and for transport convenience.

Then there is the third group of prior art examples which accommodate both the portability and structural complements, as exemplified in the teachings of U.S. Pat. No. 4,535,559 to Hall; U.S. Pat. No. 5,060,410 to Mueller, and others. While also suitable for the purposes intended, structures of this last kind are best transported in multiple packages.

Those in the art will appreciate that the function of a shooter's support structure is best utilized in the field. In stationary settings, like at a target range, the portability element is of lesser importance, and rugged, massive, multiple-support structures are acceptable. Thus it is the structural efficacy of a very light, easily carried support assembly that best satisfies the remote forest or field locations of use while hunting. It is one such structure that is disclosed herein.

SUMMARY OF THE INVENTION

Accordingly it is the general purpose and object of the present invention to provide a collapsible, portable shooting platform which is both light and very rugged once erected.

Other objects of the invention are to provide a collapsible shooter's platform that utilizes the interlinking of its pieces once assembled to enhance the stiffness thereof.

Yet further objects of the invention are to provide a folding shooter's platform which is interlocked in its unfolded form by insertable leg structures.

Briefly, these and other objects are accomplished within the present invention by providing an elongate support panel comprising longitudinal pieces that are conformed to each other and include a central generally elongated panel segment flanked at both sides by lateral panel pieces which extend adjacent a common end portion of the central segment.

At the common upper surfaces both the central segment and the two flanking pieces include a common transverse slot of a convolved section for receiving a transverse L-shaped insert extending across the panel assembly. The lower common surfaces of the panels are similarly slotted with three T-shaped recesses, the first extending longitudinally part way into the forward structure of the central segment while the other two recesses are aligned generally diagonally towards each other from the rear corners of the lateral pieces and into the central segment. A set of T-sectioned support legs are then inserted into these recesses, thus providing both the support for the assembly and also the interlocking structure keeping the panel segment and the flanking pieces together. The forward leg, moreover, may also serve as the mount for an adjustable front firearm support while a shaped transverse recess in the panel segment is useful to receive a support slide on which an adjustable rear firearm support may be deployed. It should be noted that the depth of insertion of the forward leg can be varied, thus varying the separation of the forward mount from the rear firearm support, and the lateral receipt of the slide can similarly be controlled to accommodate various firearm configuration. Additionally, the slide is insertable from both directions, thereby accommodating left-handed marksmen as well. In this manner a light, robust shooter's platform is devised which can be easily transported to a remote site.

DESCRIPTION OF THE PREFERRED EMBODIMENT

Figure 1:
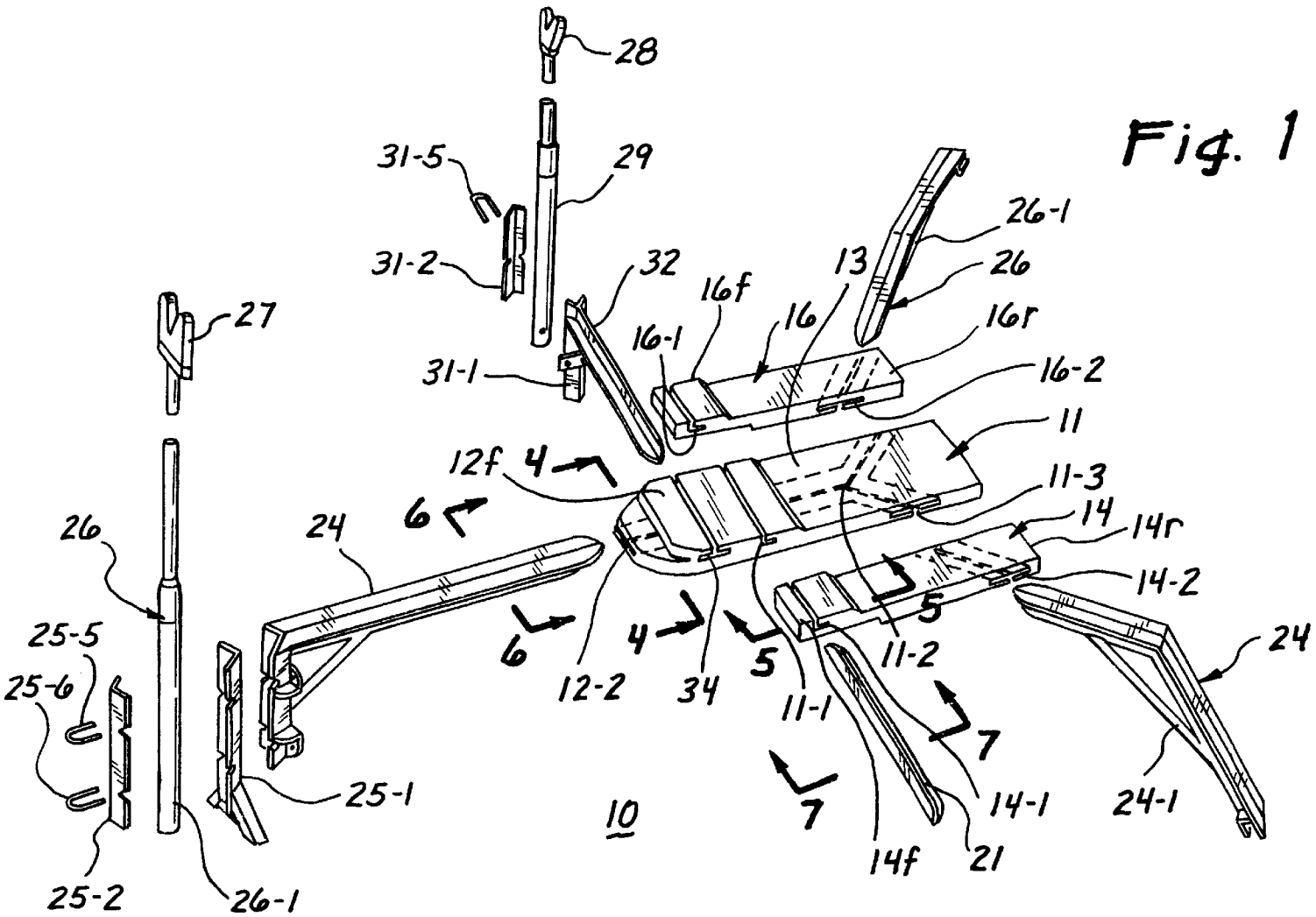
FIG. 1 is a perspective illustration, separated by parts of the inventive shooter's platform.
Figure 2:
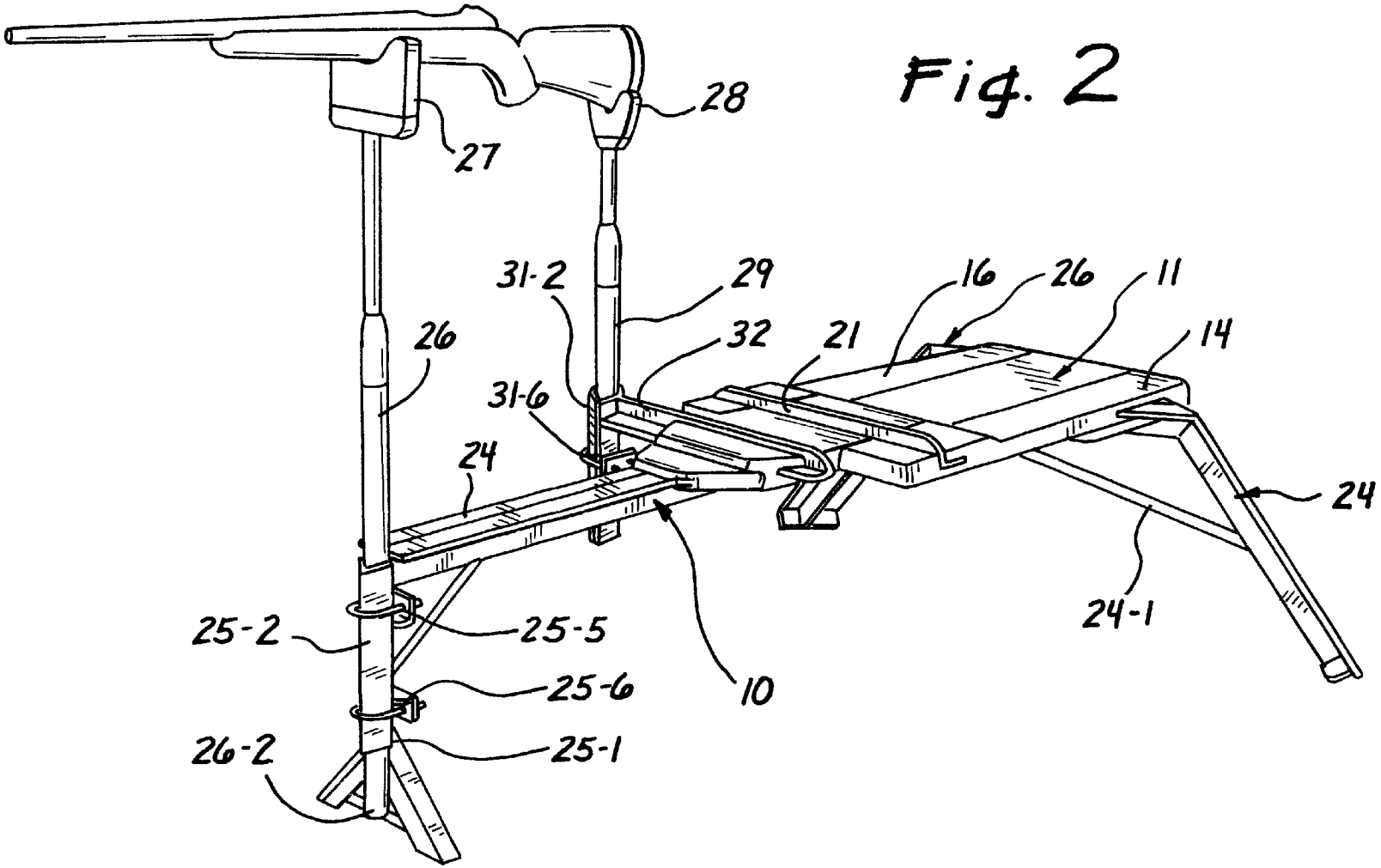
FIG. 2 is a further perspective illustration of the inventive shooter's platform in its fully assembled and deployed configuration.
Figure 3:
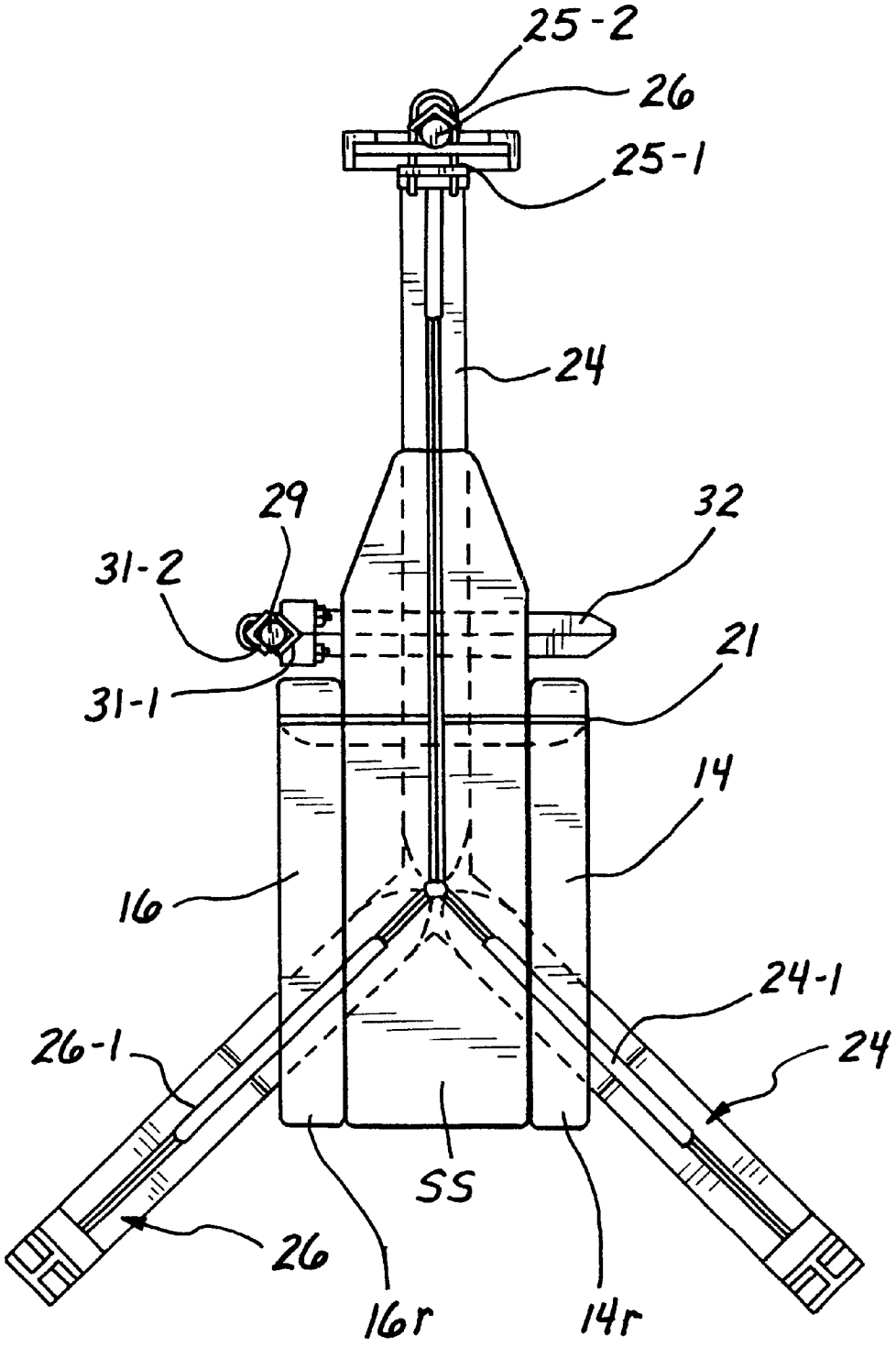
FIG. 3 is a bottom view of the inventive shooter's platform.
Figure 4:
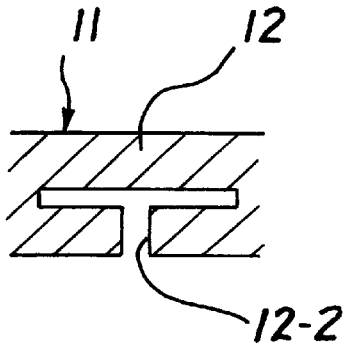
FIG. 4 is a sectional view taken along line 4—4 of FIG. 1.
Figure 5:
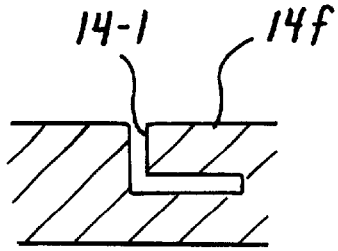
FIG. 5 is yet another detail view, in section, taken along line 5—5 of FIG. 1.
Figure 6:
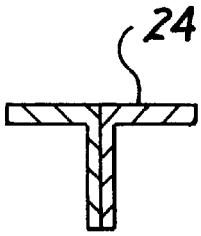
FIG. 6 is a further detail view, in section, taken along line 6—6 of FIG. 1.
Figure 7:
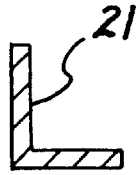
FIG. 7 is an additional detail view, in section, taken along line 7—7 of FIG. 1.

As shown in FIGS. 1–7, the inventive shooter's platform assembly, generally designated by the numeral 10, includes by a central, generally elongate, panel segment 11 characterized by a thicker forward section 12 and a thinner rear section 13. Two flanking panel pieces 14 and 16 are similarly conformed to a raised forward section **14*f* and 16*f* and a reduced rear section 14*r* and 16*r*, the combined rear portion of segment 11 and pieces 14 and 16 forming a seat surface SS behind a common transverse enlargement through which a first and a second convolved slot extend. More precisely the enlargements 14*f*, 12*f* and 16*f* adjacent the seat surface SS are each pierced with an L-shaped transverse slot 14-1, 11-1 and 16-1 which are then aligned with each other by a common insertion of a conforming L-sectioned bracket 21**. In this manner the panel segment and the lateral panel pieces are joined to each other at the forward end.

Proximate the common rear ends and subjacent the common seat surface SS the lateral pieces 14 and 16 are each diagonally slotted with a T-sectioned slot 14-2 and 16-2 which extend into the adjacent interior of the segment 11 as a chevron-shaped slot 11-2. The panel segment 11, moreover, includes a further longitudinally aligned T-sectioned slot 11-3 which extends from its forward end to the apex of slot 11-2.

A corresponding portion of a conforming T-sectioned leg 24 is then received in slot 14-2 and also partly in one side of slot 11-2. This angulated receipt of leg 24 thus fixes panel piece 14 to segment 11 with similar fixing obtained on the other side by inserting a conforming portion of another leg 26 into the common interior of slot 16-2 and the other side of slot 11-2. The exposed parts of legs 24 and 26 are then bent to provide the required ground clearance with the supported mass of the user further effecting an interlock between the panel segment and pieces.

At the same time a T-sectioned slot 12-2 is formed in the underside of the central piece 11, extending from the front end towards the chevron sectioned slot 11-2 and conformed to receive at various insertion depths a matching T-sectioned insert 24. The exposed free end of insert 24 terminates in a vertically aligned clamping assembly 25-1 and 25-2 in which a tubular base 26-1 of a telescopic mount 26 is fixed. At the upper end mount 26 then supports a rotary yoke 27 providing the front support for a firearm FA. The rear firearm support, in turn, is a similar yoke 28 on the end of yet another telescoping mount 29 clamped by a clamping assembly 31-1 and 31-2 fixed to the end of a transverse T-sectioned slide 32 which is slidably received also to various depths of insertion in either end of the other transverse slot of the central piece 11 shown as a T-sectioned slot 34.

In this manner a very rugged interlock is devised for keeping the assembly together while the marksman sits on the seat surface SS. In this position the lateral alignment of the firearm FA is easily modified by the sliding translation of slide 32 within its conforming recess 34 and the telescoping adjustment of mounts 26 and 29. The forward mount is fully adjustable as well by the expedient of selecting the insertion depth of the forward leg and the telescoping extension. Once the weight of the marksman is lifted, however, the assembly is easily taken apart for transport.

Those in the art will appreciate that the structural integrity of the assembly can be further enhanced by triangulating members 24-1 and 26-1 reinforcing the angulated legs 24 and 26. The structure integrity of the assembly is also assured by the enlarged section of the portions **12*f*, 14*f* and 16*f* of the panel pieces. Thus selective enlargements are cooperatively rendered useful with the weight of the user to produce an integral, solid support structure. Both the adjustment and the disassembly and assembly convenience of this structure is further assured by way of alignment projections 26-2 and 29-2 on the lower exteriors of the telescoping mounts 26 and 29. These mounts are thereby keyed against turning in their yokes in an assembly process facilitated by U-bolts 25-5, 25-6, and 31-5** clamping the corresponding yoke pieces by way of wing nuts in each instance. Thus a manually achievable assembly process is obtained without the necessity of any tools.

Obviously, many modifications and variations can be effected without departing from the spirit of the instant teachings. It is therefore intended that the scope of invention be determined solely by the claims appended hereto.

It is claimed:

1. An assembly useful in forming a shooter's platform, comprising:

an elongate central panel member defined by a first enlarged forward end and a planar rear surface;

a pair of lateral panels each including a second enlarged forward end and a planar rear portion each said lateral panel being conformed for deployment along one of the lateral edges of said central panel said second enlarged forward ends thereof being aligned partially along the sides of said first enlarged forward end, said first and second enlarged forward ends each including a first slot conformed for a common transverse alignment upon the alignment of said side panels relative said central panel;

an elongate insert conformed for sliding receipt in the common interior of said first slots in said central and side panels for effecting an interlock therebetween;

a second slot formed in the forward end of said central panel extending generally centrally therein subjacent said first enlarged forward end;

a third slot extending transversely across the first enlarged forward end in substantially parallel alignment relative said first slot;

a fourth and fifth slot each respectively formed in the rear exterior ends of said lateral pieces, each extending generally along a diagonal through the underside of said lateral pieces and into said central panel towards the inner end of said second slot;

a first leg assembly including a received portion received in said second slot, said first leg assembly including an adjustable forward mount;

a second and third leg assembly each including a corresponding received portion received in said fourth and fifth slots; and a slidable mount piece including a sliding portion conformed for sliding receipt in said third slot and an adjustable rear mount at one end thereof.

2. An assembly according to claim 1, wherein said front and rear mounts each include adjustable by telescoping extension vertical pieces each provided with a yoke at the upper end thereof.

3. An assembly according to claim 2, wherein:

said third slot is conformed to communicate to the exterior on both said lateral edges of said central panel; and said sliding portion of said slidable mount piece is receivable in said third slot from either one of said lateral edges.

4. An assembly according to claim 3, wherein said received portions of the corresponding ones of said second and third leg assemblies extend through the common interior of the corresponding ones of said fourth and fifth slots extending both through the lateral panels and said central panel, whereby the weight of said shooter supported on said panels effects an interlock therebetween.

5. An assembly useful in forming a seat structure for supporting a person thereon, comprising:

a plurality of planar panels conformed for adjacent alignment to form a common surface, a selected one of said panels including a generally longitudinal slot extending from one panel end partly into the panel interior and selected other panels including generally transverse slots therethrough communicating with correspondingly transverse slot ends in said selected one panel formed adjacent the interior end of said longitudinal slot;

a plurality of leg pieces each including an insertable portion conformed for receipt in a corresponding one of said longitudinal and transverse slots to cooperatively form a support surface whereby the supported weight thereon effects an interlocked engagement between a selected one of said insertable portions, said transverse slot and said transverse slot end; and a common transverse member conformed to extend across through the combination of said panels aligned adjacent each other to form a support surface, said panels each including a corresponding common opening conformed for sliding receipt of said transverse member.

6. An assembly according to claim 5, wherein said leg piece inserted in said longitudinal slot further includes a first adjustable mount extending generally orthogonal to the plane defined by said panels.

7. An assembly according to claim 6, further comprising a second adjustable mount slidably engaged to said selected one panel and conformed for transverse displacement relative thereto.

8. An assembly according to claim 7, wherein said first and second mounts each include telescopically extensible vertical pieces each provided with a yoke at the upper end thereof.

9. An assembly according to claim 8, wherein each said first and second mount includes manually operable attachment means for attaching said vertical pieces thereto.

10. An assembly of a plurality of components each conformed for manual interconnection with the others to form a support structure useful in supporting a marksman, comprising:

a first generally elongate panel piece defined by an upper surface and a lower surface;

a second and third elongate panel piece each of a longitudinal dimension shorter than said first panel piece, each said second and third panel pieces being defined by an upper and a lower surface and each including a lateral edge conformed for alignment adjacent a selected one of the lateral edges of said first panel piece, said first, second and third panel pieces being each further defined by a forward and a rear end;

a first slot formed in said first panel piece extending from said front end generally longitudinally into the interior thereof in an alignment adjacent the lower surface;

a pair of slot ends extending transversely into the interior of said first panel piece towards the interior end of said first slot;

a second and third slot each respectively extending generally transversely through the corresponding second and third panel piece and aligned to communicate with one of said slot ends upon the alignment of each of said second and third panel pieces along a corresponding edge of said first panel piece;

a fourth slot extending across the aligned combination of said first, second and third panel pieces;

a transverse element slidably received in said fourth slot; and a first, second and third leg each including an insertable segment respectively received in the corresponding first, second and third slots, the insertable segments of said second and third leg further extending into the corresponding one of said slot ends.

11. An assembly according to claim 10, wherein said leg piece inserted in said longitudinal slot further includes a first adjustable mount extending generally orthogonal to the common plane defined by said panel pieces.

12. An assembly according to claim 11, further comprising a second adjustable mount slidably engaged to said first panel piece and conformed for transverse displacement relative thereto.

13. An assembly according to claim 12, wherein said first and second mounts each include telescopically extensible vertical pieces each provided with a yoke at the upper end thereof.

* * * * *